US011631952B2

(12) United States Patent
Kim et al.

(10) Patent No.: US 11,631,952 B2
(45) Date of Patent: Apr. 18, 2023

(54) CONNECTOR ASSEMBLY AND METHOD FOR MANUFACTURING THE SAME

(71) Applicants: HYUNDAI MOTOR COMPANY, Seoul (KR); KIA CORPORATION, Seoul (KR); Kyungshin Corporation, Incheon (KR)

(72) Inventors: Ji Hyoung Kim, Gunpo-si (KR); Jung Nan Ryu, Gunpo-si (KR); Min Woo Kim, Incheon (KR); Sang Un Lee, Incheon (KR); Jae Ho Park, Incheon (KR)

(73) Assignees: HYUNDAI MOTOR COMPANY, Seoul (KR); KIA CORPORATION, Seoul (KR); Kyungshin Corporation, Incheon (KR)

( * ) Notice: Subject to any disclaimer, the term of this patent is extended or adjusted under 35 U.S.C. 154(b) by 58 days.

(21) Appl. No.: 17/237,411

(22) Filed: Apr. 22, 2021

(65) Prior Publication Data

US 2022/0140531 A1 May 5, 2022

(30) Foreign Application Priority Data

Nov. 3, 2020 (KR) ..... 10-2020-0145397

(51) Int. Cl.
*H01R 13/64* (2006.01)
*H01R 13/502* (2006.01)
(Continued)

(52) U.S. Cl.
CPC ..... *H01R 13/64* (2013.01); *H01R 13/436* (2013.01); *H01R 13/502* (2013.01); *H01R 13/719* (2013.01); *H01R 13/7193* (2013.01)

(58) Field of Classification Search
CPC .... H01R 13/64; H01R 13/436; H01R 13/502; H01R 13/719; H01R 13/7193;
(Continued)

(56) References Cited

U.S. PATENT DOCUMENTS 5,007,888 A 4/1991 Goutiere
5,749,753 A 5/1998 Chishima et al.
(Continued)

FOREIGN PATENT DOCUMENTS

JP 3754304 B2 * 3/2006 ..... H01R 13/514
KR 101783862 B1 * 10/2017
KR 10-2018-0044090 A 5/2018

OTHER PUBLICATIONS

PE2E Machine Translation KR_101783862_B1 (Oct. 2017) (Year: 2022).*

(Continued)

*Primary Examiner* — Travis S Chambers
(74) *Attorney, Agent, or Firm* — Lempia Summerfield Katz LLC

(57) ABSTRACT

A connector assembly includes: a housing having a plurality of accommodating grooves into which a plurality of terminals are insertable, respectively, and having an insertion space recessed in a first direction intersecting a second direction in which the accommodating grooves extend, the plurality of accommodating grooves being formed in one surface of the housing; a terminal position assurance (TPA) mechanism inserted into the insertion space of the housing in the first direction, having a plurality of through-holes extending parallel to the plurality of accommodating grooves, and inhibiting the terminals inserted into the
(Continued)

through-holes from being separated; joint terminals extending from an inside of the housing to the accommodating grooves, and electrically connected to the terminals inserted into the accommodating grooves; and a noise filter fixed to the housing or the TPA mechanism, and enclosing the accommodating grooves of the housing, the through-holes of the TPA mechanism, or the joint terminals.

10 Claims, 5 Drawing Sheets

(51) Int. Cl.
*H01R 13/436* (2006.01)
*H01R 13/719* (2011.01)
*H01R 13/7193* (2011.01)

(58) Field of Classification Search
CPC ..... H01R 13/4361; H01R 13/7195; H01R 2107/00; H01R 2201/26; H01R 13/658; H01R 13/514; H01R 13/629
See application file for complete search history.

(56) References Cited

U.S. PATENT DOCUMENTS

| | | | | |
|---|---|---|---|---|
| 7,241,168 | B2 | 7/2007 | Sakurai et al. | |
| 8,690,607 | B2 | 4/2014 | Tsukamoto et al. | |
| 9,761,978 | B2 | 9/2017 | Kim et al. | |
| 10,148,034 | B2 | 12/2018 | Lyon et al. | |
| 10,483,675 | B2 | 11/2019 | Nishiyama et al. | |
| 10,651,604 | B2 | 5/2020 | Tsukamoto | |
| 2012/0295491 | A1 | 11/2012 | Ito | |
| 2013/0303023 | A1 | 11/2013 | Miwa et al. | |
| 2016/0156119 | A1* | 6/2016 | Lee ..... | H01R 13/4361 439/660 |
| 2017/0040731 | A1 | 2/2017 | Nishiyama et al. | |
| 2019/0109416 | A1 | 4/2019 | Tsukamoto | |
| 2019/0109417 | A1* | 4/2019 | Tsukamoto ..... | H01R 13/7193 |
| 2019/0109418 | A1 | 4/2019 | Tsukamoto | |

OTHER PUBLICATIONS

PE2E Machine Translation JP_3754304_B2 (Mar. 2006) (Year: 2022).*
Office Action issued in related U.S. Appl. No. 17/237,283, dated May 11, 2022 (7 pages).

* cited by examiner

FIG. 1 "PRIOR ART"

FIG. 5
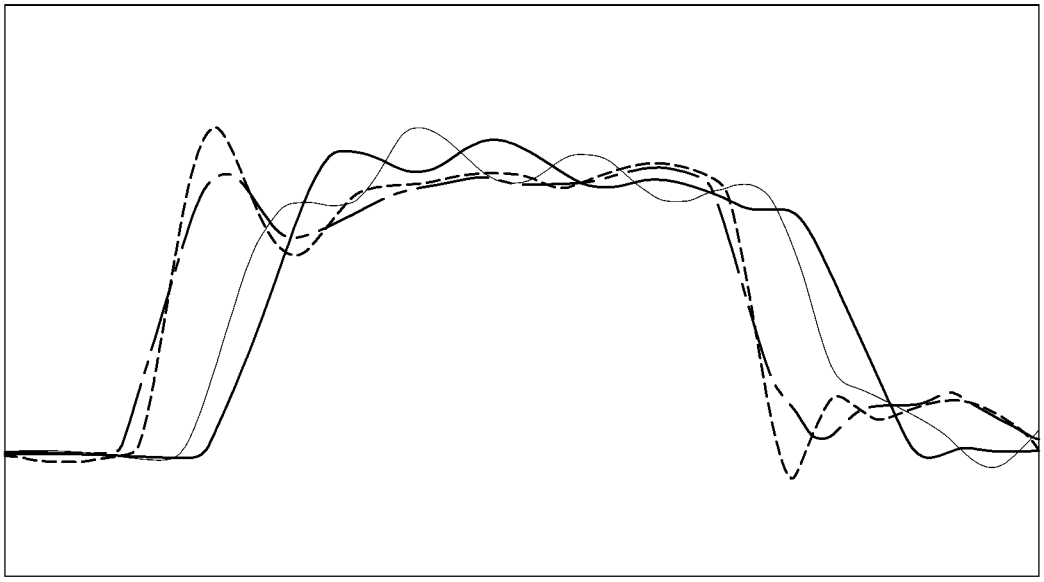
BEFORE APPLYING FILTER
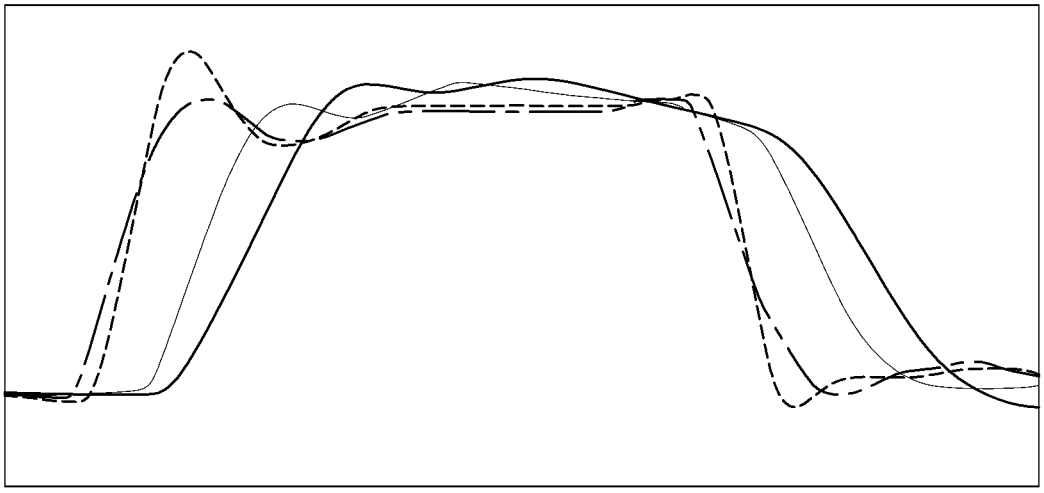
AFTER APPLYING FILTER

CONNECTOR ASSEMBLY AND METHOD FOR MANUFACTURING THE SAME

CROSS REFERENCE TO RELATED APPLICATION

This application claims priority to and the benefit of Korean Patent Application No. 10-2020-0145397, filed on Nov. 3, 2020, the entire contents of which are incorporated herein by reference.

FIELD

The present disclosure relates to a connector assembly and a method for manufacturing the same, and more particularly, to a connector assembly for reducing noise of an input signal.

BACKGROUND

The statements in this section merely provide background information related to the present disclosure and may not constitute prior art.

Recently, various electronic devices have been developed. Such an electronic device includes a housing formed of an insulating material, and a connector formed in the housing and including terminals formed of a conductive material, and the terminals are electrically connected by the connector to form a circuit.

In particular, information is transferred to a joint connector applied to wiring of a vehicle through controller area network (CAN) in a vehicle, and a large amount of information is transferred through a communication joint connector for a vehicle safety and convenience system.

Further, malfunction is caused by noise generated in a transmitted signal due to an increased communication speed resulting from the change into controller area network with flexible data-rate (CAN FD), which is a critical problem.

FIG. 1 is an exploded perspective view of a connector assembly according to the related art.

Referring to FIG. 1, in the connector assembly according to the related art, a cover 30 in which joint terminals 20 are provided is coupled to a housing 10. Since multiple joint terminals 20 are coupled by the separate cover 30, a great insertion force is desired at the time of fastening, and thus the fastening may be incomplete, which is problematic.

In addition, noise included in a signal input to the joint terminal 20 through a terminal inserted into the housing 10 is transferred through the joint terminal 20 and other terminals as it is.

The matters described as the related art have been provided only for assisting in the understanding for the background of the present disclosure and should not be considered as corresponding to the related art known to those skilled in the art.

SUMMARY

The present disclosure provides a connector assembly that reduces noise included in a signal input to a joint terminal through a terminal inserted into a housing.

According to one form of the present disclosure, a connector assembly includes: a housing having a plurality of accommodating grooves into which a plurality of terminals are inserted, respectively, and having an insertion space recessed in a first direction intersecting a second direction in which the accommodating grooves extend, the plurality of accommodating grooves being formed in one surface of the housing; a terminal position assurance (TPA) mechanism inserted into the insertion space of the housing in the first direction intersecting the second direction, having a plurality of through-holes extending parallel to the plurality of accommodating grooves, and inhibiting the terminals inserted into the through-holes from being separated; joint terminals extending from an inside of the housing to the accommodating grooves, and electrically connected to the terminals inserted into the accommodating grooves; and at least one noise filter fixed to the housing or the TPA mechanism, and enclosing the accommodating grooves of the housing, the through-holes of the TPA mechanism, or the joint terminals.

The connector assembly may further include a protection cap that is coupled to the housing in a direction facing the surface of the housing in which the accommodating grooves of the housing are formed, and externally covers the joint terminals.

The joint terminals may be fixed in the housing and extend toward the plurality of accommodating grooves, respectively, while being in an integrally connected state.

The plurality of through-holes formed in the TPA mechanism may be formed at positions corresponding to the plurality of accommodating grooves formed in the housing, respectively.

The noise filter may be a ferrite core that filters out electromagnetic interference included in a signal input from the terminal inserted into the accommodating groove or output to the terminal.

The noise filter may be inserted into the TPA mechanism and integrally coupled to the TPA mechanism.

The noise filter may enclose the through-holes, and externally enclose the terminals that penetrate through the through-holes to be inserted into the through-holes.

The noise filter may enclose one or more through-holes, and a plurality of noise filters may be provided while being spaced apart from each other.

According to another form of the present disclosure, a method for manufacturing the connector assembly includes: inserting the joint terminals into the accommodating grooves of the housing; fixing the noise filter to the housing or the TPA mechanism so as to enclose the accommodating groove of the housing, the through-hole of the TPA mechanism, or the joint terminal; and inserting the TPA mechanism into the insertion space of the housing in the direction intersecting the direction in which the accommodating grooves extend.

The method may further include, after the inserting of the TPA mechanism, coupling a protection cap that externally covers the joint terminals to the housing in a direction that faces the surface of the housing in which the accommodating grooves are formed.

In the fixing of the noise filter to the housing or the TPA mechanism, the noise filter that encloses the through-hole may be inserted into the TPA mechanism so as to externally enclose the terminal that penetrates through the through-hole to be inserted into the through-hole.

In the inserting of the TPA mechanism, the TPA mechanism may be inserted so that the plurality of through-holes formed in the TPA mechanism correspond to the plurality of accommodating grooves formed in the housing.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 5 illustrates signal waveforms before and after applying the connector assembly in one form of the present disclosure.

Figure 1:
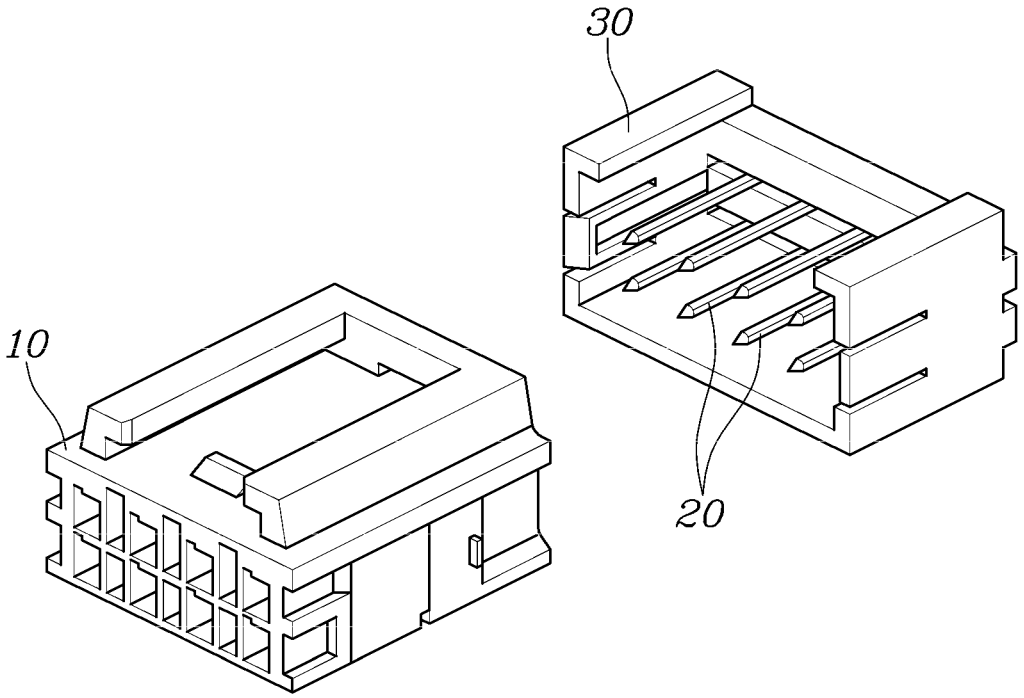
FIG. 1 is an exploded perspective view of a connector assembly according to the related art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Specific structural and functional descriptions will be provided only in order to describe various forms of the present disclosure disclosed in the present specification or disclosure. Therefore, forms of the present disclosure may be implemented in various forms, and the present disclosure is not to be interpreted as being limited to forms described in the present specification or disclosure.

Since forms of the present disclosure may be variously modified and may have several forms, specific forms will be shown in the accompanying drawings and will be described in detail in the present specification or disclosure. However, it is to be understood that the present disclosure is not limited to specific forms, but includes all modifications, equivalents, and substitutions included in the spirit and the scope of the present disclosure.

Terms such as "first", "second", etc., may be used to describe various components, but the components are not to be construed as being limited to the terms. The terms are used only to distinguish one component from another component. For example, the "first" component may be named the "second" component and the "second" component may also be similarly named the "first" component, without departing from the scope of the present disclosure.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween. Other expressions describing a relationship between components, that is, "between", "directly between", "neighboring to", "directly neighboring to" and the like, should be similarly interpreted.

Terms used in the present specification are used only in order to describe specific forms rather than limiting the present disclosure. Singular forms used herein are intended to include plural forms unless context explicitly indicates otherwise. It will be further understood that the terms "comprise" or "have" used in this specification, specify the presence of stated features, steps, numerals, operations, components, parts, or a combination thereof, but do not preclude the presence or addition of one or more other features, numerals, steps, operations, components, parts, or a combination thereof.

Unless indicated otherwise, it is to be understood that all the terms used in the specification including technical and scientific terms have the same meaning as those that are understood by those who skilled in the art. It must be understood that the terms defined by the dictionary are identical with the meanings within the context of the related art, and they should not be ideally or excessively formally defined unless the context clearly dictates otherwise.

Hereinafter, exemplary forms of the present disclosure will be described in detail with reference to the accompanying drawings. Like reference numerals proposed in each drawing denote like components.

Figure 2:
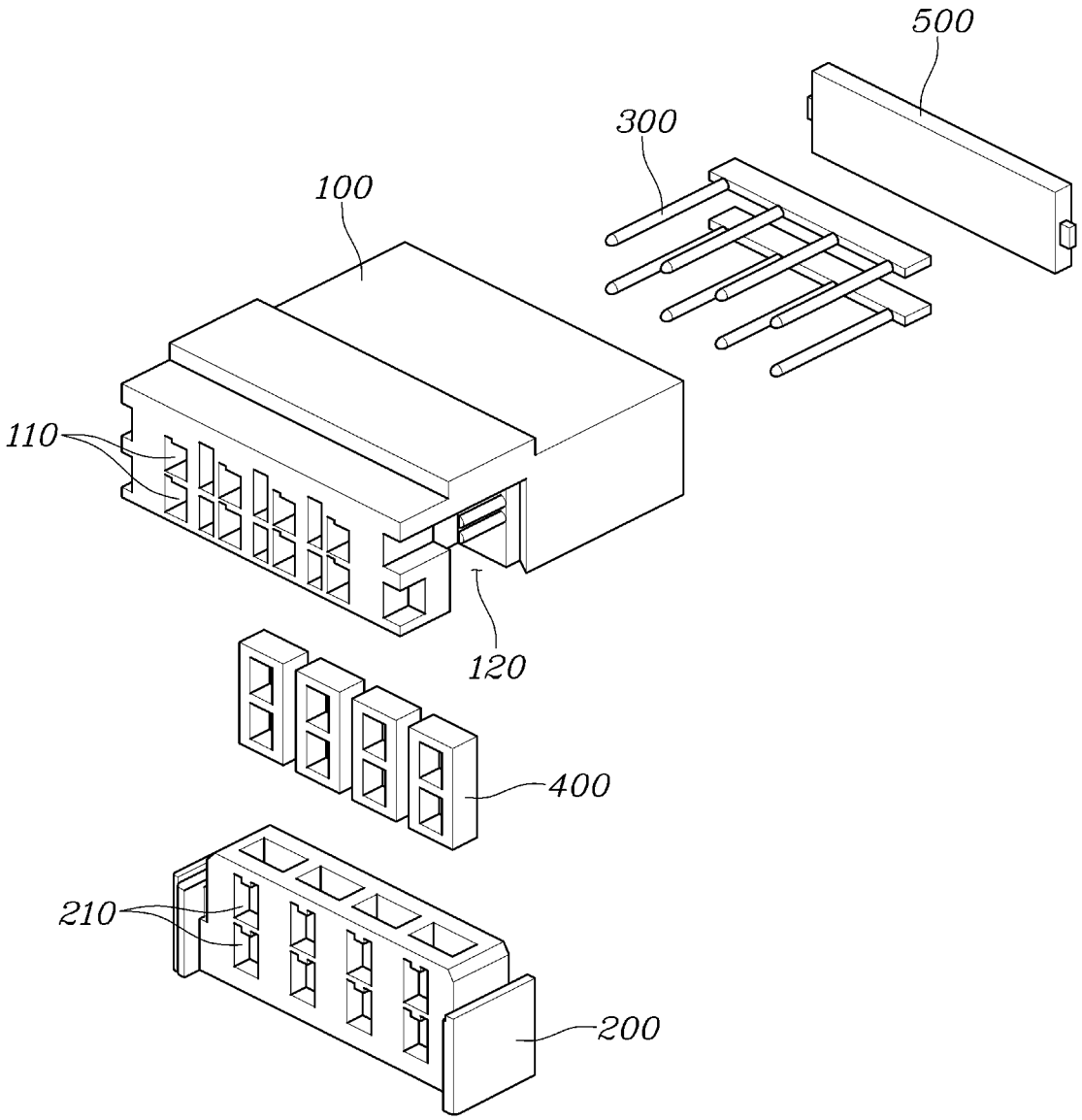
FIG. 2 is an exploded perspective view of a connector assembly according to one form of the present disclosure.
Figure 3:
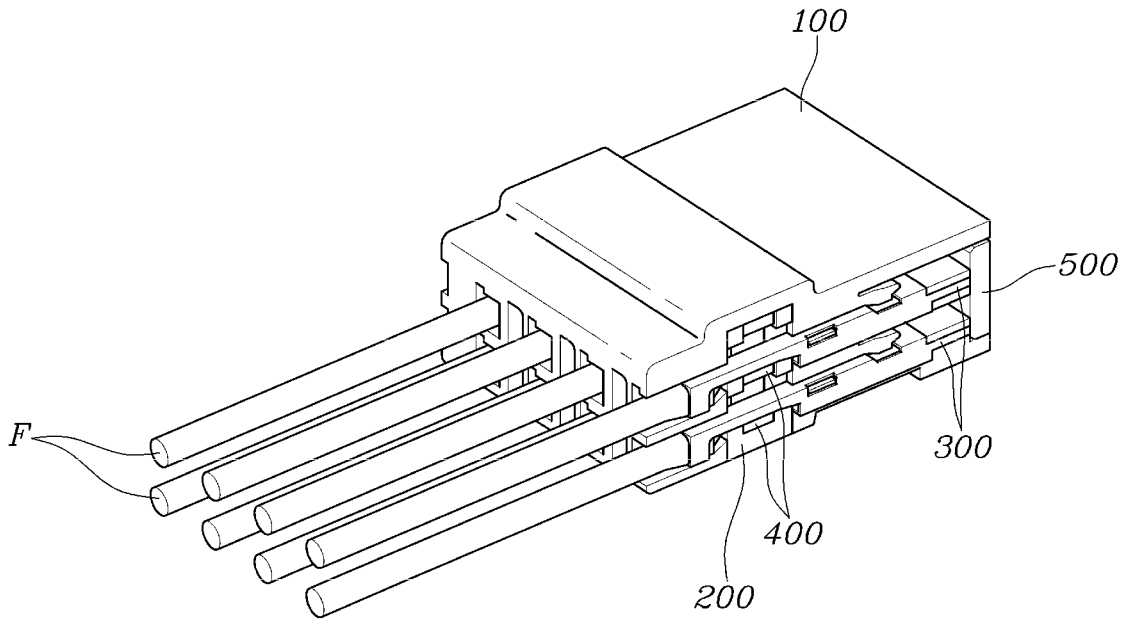
FIG. 3 is a perspective view of the connector assembly in an assembled state according to another form of the present disclosure.

FIG. 2 is an exploded perspective view of a connector assembly according to one form of the present disclosure, and FIG. 3 is a perspective view of the connector assembly in an assembled state according to another form of the present disclosure.

Referring to FIGS. 2 and 3, the connector assembly includes: a housing 100 having a plurality of accommodating grooves 110 into which a plurality of terminals F are insertable, respectively, and having an insertion space 120 recessed in a direction intersecting a direction in which the accommodating grooves 110 extend, the plurality of accommodating grooves 110 being formed in one surface of the housing 100; a terminal position assurance (TPA) mechanism 200 inserted into the insertion space 120 of the housing in the direction intersecting the direction in which the accommodating grooves 110 extend, having a plurality of through-holes 210 extending parallel to the plurality of accommodating grooves 110, and preventing the terminals F inserted into the through-holes 210 from being separated; joint terminals 300 extending from the inside of the housing 100 to the accommodating grooves 110, and electrically connected to the terminals F inserted into the accommodating grooves 110; and a noise filter 400 fixed to the housing 100 or the TPA mechanism 200, and enclosing the accommodating groove 110 of the housing 100, the through-hole 210 of the TPA mechanism 200, or the joint terminal 300.

The plurality of accommodating grooves 110 may be formed in one side surface of the housing 100. The plurality of accommodating grooves 110 may be recessed inward at one side surface of the housing 100, extend parallel to each other, and be spaced apart from each other.

Further, the insertion space 120 that is recessed in the direction intersecting the direction in which the accommodating grooves 110 extend, particularly, in an upward direction or downward direction, may be formed in an upper surface or lower surface of the housing 100. The TPA mechanism 200 as described later may be inserted into the insertion space 120 and fixed to the housing 100.

The TPA mechanism is a component inserted into the insertion space of the housing 100, and may be inserted in the direction intersecting the direction in which the accommodating grooves 110 extend.

The TPA mechanism 200 may have the through-holes 210 extending in a direction parallel to the direction in which the accommodating grooves 110 of the housing 100 extend. The terminal F inserted into the accommodating groove 110 in a state where the TPA mechanism 200 is inserted into the insertion space 120 of the housing 100 may be inserted into the through-hole 210. The TPA mechanism 200 may inhibit or prevent the terminal F inserted into the accommodating groove 110 and the through-hole 210 from being separated.

In the housing 100, the joint terminals 300 may be fixed to the housing 100. According to one form, the joint terminals 300 may be inserted into the housing 100 and coupled while being in contact with the housing 100.

In the joint terminal 300, a plurality of end portions may extend toward the accommodating grooves 110 of the housing 100, respectively, and the plurality of end portions may be electrically connected to each other to form a circuit. Further, the plurality of end portions extending toward the accommodating grooves 110 of the housing 100 may be electrically connected to the terminals F inserted into the accommodating grooves 110 of the housing 100.

The noise filter 400 may be directly fixed to the housing 100 or may be indirectly fixed to the housing 100 while being fixed to the TPA mechanism 200. Particularly, the noise filter 400 may enclose the accommodating groove 110 of the housing 100, or may enclose the through-hole 210 of the TPA mechanism 200 to thereby externally enclose the terminal F inserted into the accommodating groove 110 and the through-hole 210. According to another form, the noise filter 400 may externally enclose the end portions of the joint terminal 300.

According to one form, the noise filter 400 may be a ferrite core that filters out electromagnetic interference.

The connector assembly may further include a protection cap 500 that is coupled to the housing 100 in a direction facing the surface of the housing 100 in which the accommodating grooves 110 are formed, and externally covers the joint terminals 300.

The protection cap 500 may have a plane shape extending in a direction parallel to one side surface of the housing 100, and may be integrally coupled to the housing 100 at outer sides of the joint terminals 300 in a state where the joint terminals 300 are coupled to the housing 100.

The protection cap 500 may externally cover the joint terminals 300 exposed at a surface opposite to the one side surface in which the accommodating grooves 110 are formed, thereby inhibiting or preventing the joint terminals 300 from being in contact to the outside.

In another form, the joint terminals 300 may be fixed in the housing 100 and extend toward the plurality of accommodating grooves 110, respectively, while being in an integrally connected state.

In the joint terminal 300, the plurality of end portions may be connected to each other to form a circuit, and each end portion may extend toward each accommodating groove 110 to be electrically connected to the terminal F inserted into the accommodating groove 110.

The plurality of through-holes 210 formed in the TPA mechanism 200 may be formed at positions corresponding to the plurality of accommodating grooves 110 formed in the housing 100, respectively.

That is, the TPA mechanism 200 inserted into the insertion space 120 of the housing 100 that is recessed in the direction intersecting the direction in which the accommodating grooves 110 extend may have the through-holes 210 extending in the direction in which the accommodating grooves 110 extend. The plurality of through-holes 210 may be arranged parallel to the plurality of accommodating grooves 110 in a state where the TPA mechanism 200 is inserted into the insertion space 120.

The noise filter 400 may be a ferrite core that filters out electromagnetic interference included in a signal input from the terminal F inserted into the accommodating groove 110 or a signal output to the terminal F. The ferrite core may remove reflected waves or noise of a signal transferred to an adjacent terminal F or the joint terminal 300.

The noise filter 400 may be inserted into the TPA mechanism 200 and integrally coupled to the TPA mechanism 200.

In other form, the noise filter 400 may be inserted into the TPA mechanism 200 from above or below the TPA mechanism 200 and integrally coupled to the TPA mechanism 200.

In particular, the noise filter 400 may enclose the through-hole 210, and externally enclose the terminal F that penetrates through the through-hole 210 to be inserted into the through-hole 210.

Therefore, the noise filter 400 may remove noise or the like included in a signal transferred through the terminal F from the outside of the terminal F.

According to another form, the noise filter 400 may enclose one or more through-holes 210, and a plurality of noise filters 400 may be provided while being spaced apart from each other.

Specifically, the noise filter 400 may enclose an outer circumferential surface of the terminal F inserted into each through-hole 210. The noise filter 400 enclosing each through-hole 210 may be integrally coupled to an adjacent noise filter 400. In addition, the plurality of noise filters 400 may be spaced part from each other, and each of the noise filters 400 may be coupled to the TPA mechanism 200.

Figure 4:
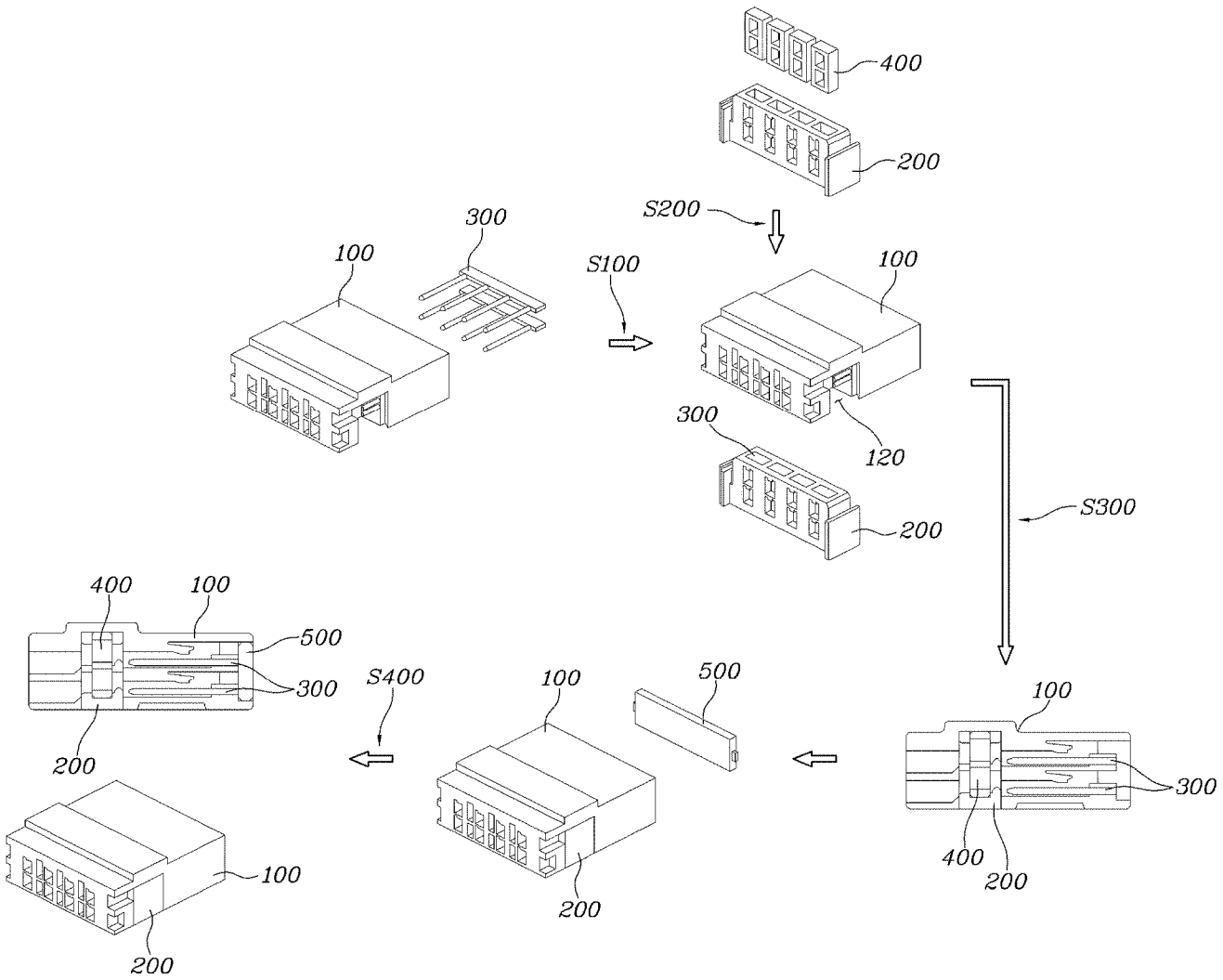
FIG. 4 illustrates a method for manufacturing a connector assembly according to one form of the present disclosure.

FIG. 4 illustrates a method for manufacturing a connector assembly according to one form of the present disclosure.

Referring to FIG. 4, the method for manufacturing a connector assembly includes: inserting the joint terminals 300 into the accommodating grooves 110 of the housing 100 (S100); fixing the noise filter 400 to the housing 100 or the TPA mechanism 200 so as to enclose the accommodating groove 110 of the housing 100, the through-hole 210 of the TPA mechanism 200, or the joint terminal 300 (S200); and inserting the TPA mechanism 200 into the insertion space 120 of the housing 100 in the direction intersecting the direction in which the accommodating grooves 110 extend (S300).

According to another form, the inserting of the joint terminals 300 into the accommodating grooves 110 of the housing 100 (S100) may be performed after or at the same time as the fixing of the noise filter 400 to the housing 100 or the TPA mechanism 200 (S200).

The method for manufacturing a connector assembly may further include, after the inserting of the TPA mechanism 200 (S300), coupling the protection cap 500 that externally covers the joint terminals 300 to the housing 100 in the direction that faces the surface of the housing 100 in which the accommodating grooves 110 are formed (S400).

In the fixing of the noise filter 400 to the housing 100 or the TPA mechanism 200 (S200), the noise filter 400 that encloses the through-hole 210 may be inserted into the TPA mechanism 200 so as to externally enclose the terminal F that penetrates through the through-hole 210 to be inserted into the through-hole 210.

In the inserting of the TPA mechanism 200 (S300), the TPA mechanism 200 may be inserted so that the plurality of through-holes 210 formed in the TPA mechanism 200 correspond to the plurality of accommodating grooves 110 formed in the housing 100, respectively.

FIG. 5 illustrates signal waveforms before and after applying the connector assembly according to one form of the present disclosure.

Referring to FIG. 5, with the change of a communication protocol from controller area network (CAN) into controller area network with flexible data-rate (CAN FD), a communication speed has increased and a communication cycle has decreased. In a case of the CAN communication, a section in which a signal is instable due to noise is short, but in a case of the CAN FD communication with the increased communication speed and decreased communication cycle, a section in which a signal is instable due to noise is relatively long.

That is, in a case of the CAN FD communication, it is likely that a vehicle malfunctions due to noise of a signal or the like of a controller.

However, as illustrated in FIG. 5, in a case of applying the noise filter 400 according to the present disclosure, signal instability due to noise is relatively reduced, such that a section in which a signal is stable increases.

In the connector assembly and the method for manufacturing the same according to the present disclosure, a cover separately coupled to the housing is omitted, such that the assembling process is simplified and fastening quality is improved.

In addition, noise included in a signal input to the joint terminal through the terminal inserted into the connector assembly is reduced.

Although the present disclosure has been shown and described with respect to the exemplary forms, it will be obvious to those skilled in the art that the present disclosure may be variously modified and altered without departing from the spirit and scope of the present disclosure.

What is claimed is:

1. A connector assembly comprising:

a housing including:

a plurality of accommodating grooves into which a plurality of terminals are inserted, respectively, and an insertion space recessed in a first direction intersecting a second direction in which the plurality of accommodating grooves extend, the plurality of accommodating grooves being formed in one surface of the housing;

a terminal position assurance (TPA) mechanism inserted into the insertion space of the housing in the first direction, having a plurality of through-holes extending parallel to the plurality of accommodating grooves, and configured to inhibit the plurality of terminals inserted into the plurality of through-holes from being separated;

joint terminals extending from an inside of the housing to the plurality of accommodating grooves, and electrically connected to the plurality of terminals inserted into the plurality of accommodating grooves; and at least one noise filter fixed to the housing or the TPA mechanism, and configured to enclose the plurality of accommodating grooves of the housing, the plurality of through-holes of the TPA mechanism, or the joint terminals, wherein the at least one noise filter is inserted into the TPA mechanism and integrally coupled to the TPA mechanism.

2. The connector assembly of claim 1, further comprising: a protection cap coupled to the housing in a direction facing the surface of the housing in which the plurality of accommodating grooves are formed, the protection cap configured to externally cover the joint terminals.

3. The connector assembly of claim 1, wherein the joint terminals are fixed in the housing and extend toward the plurality of accommodating grooves, respectively, while being in an integrally connected state.

4. The connector assembly of claim 1, wherein the plurality of through-holes formed in the TPA mechanism are formed at positions corresponding to the plurality of accommodating grooves formed in the housing, respectively.

5. The connector assembly of claim 1, wherein the at least one noise filter is a ferrite core and configured to filter out electromagnetic interference included in a signal input from the plurality of terminals inserted into the plurality of accommodating grooves or a signal output to the plurality of terminals.

6. The connector assembly of claim 1, wherein the at least one noise filter is configured to enclose the plurality of through-holes, and externally enclose the plurality of terminals that penetrate through the plurality of through-holes.

7. The connector assembly of claim 1, wherein:

the at least one noise filter is configured to enclose at least one through-hole of the plurality of through-holes, and the at least one noise filter includes a plurality of noise filters and noise filters of the plurality of noise filters are provided while being spaced apart from each other.

8. A method for manufacturing a connector assembly, where the connector assembly includes: a housing including accommodating grooves to receive terminals and an insertion space formed thereon, a terminal position assurance (TPA) mechanism inserted into the insertion space and having through-holes, joint terminals electrically connected to the terminals, and a noise filter, the method comprising:

inserting the joint terminals into the accommodating grooves of the housing;

fixing the noise filter to the housing or the TPA mechanism so as to enclose the accommodating grooves of the housing, the through-holes of the TPA mechanism, or the joint terminals; and inserting the TPA mechanism into the insertion space of the housing in a direction intersecting a direction in which the accommodating grooves extend, wherein in fixing the noise filter to the housing or the TPA mechanism, the noise filter that encloses the through-holes is inserted into the TPA mechanism so as to externally enclose the terminals that penetrate through the through-holes to be inserted into the through-holes.

9. The method of claim 8, further comprising, after the inserting of the TPA mechanism, coupling a protection cap that externally covers the joint terminals to the housing in a direction that faces a surface of the housing in which the accommodating grooves are formed.

10. The method of claim 8, wherein in inserting the TPA mechanism, the TPA mechanism is inserted such that the through-holes formed in the TPA mechanism correspond to the accommodating grooves formed in the housing.

* * * * *